United States Patent [19]

Hanula

[11] 4,310,099

[45] Jan. 12, 1982

[54] ROTARY CONNECTOR

[75] Inventor: Richard M. Hanula, Lyndhurst, Ohio

[73] Assignee: Midland-Ross Corporation, Cleveland, Ohio

[21] Appl. No.: 139,813

[22] Filed: Apr. 14, 1980

[51] Int. Cl.[3] ..... B61G 9/00

[52] U.S. Cl. ..... 213/62 A; 213/69; 213/72

[58] Field of Search ..... 213/62 R-65, 213/67 R, 67 A, 69-72

[56] References Cited

U.S. PATENT DOCUMENTS

| | | | |
|---|---|---|---|
| 2,240,363 | 4/1941 | Barrows et al. | 213/62 A |
| 2,850,180 | 9/1958 | Kayler et al. | 213/72 |
| 2,956,693 | 10/1960 | Blattner | 213/72 |
| 2,973,105 | 2/1961 | Metzger | 213/71 |
| 4,243,149 | 1/1981 | Depenti | 213/62 A |

*Primary Examiner*—Randolph A. Reese

*Attorney, Agent, or Firm*—Harlan E. Hummer

[57] ABSTRACT

A rotary railroad car coupler is described as having a rotary connector with a spherical butt end for seating engagement in a spherical cavity formed in an adjacent front follower.

7 Claims, 2 Drawing Figures

ROTARY CONNECTOR

BACKGROUND OF THE INVENTION

The invention is designed for use with a rotary railroad car coupler, especially the rotary connector used in rotatably attaching the shank of the car coupler to the yoke.

U.S. Pat. No. 2,973,104 is typical of the many patents which show a rotary railroad car coupler having an open back end rotary connector to which is pinned a coupler shank that has a spherical butt end which protrudes from the open back end of the rotary connector and seats in a spherical concavity formed in an adjacent front follower. Rotary connectors of this type generally require a special car endsill which is larger than an AAR standard endsill.

U.S. Pat. No. 2,973,105 is directed to a more rigid rotary connector which has a closed back end that envelopes the spherical butt end of the coupler shank and can be used in connection with an AAR standard endsill. This rotary connector is provided with a flat butt end which is designed to seat and rotate against the flat face of an adjacent front follower. Rotary connectors of this type were found to experience the problem of imparting against the front follower, forces that caused movement of the front follower against the yoke to unduly wear the yoke straps. The invention is directed to the solution of this problem by the provision of a rotary connector which does not tend to move the front follower and which has improved fatigue and wear characteristics which help to extend the useful life of the rotary connector.

Briefly stated, the invention is in a rotary railroad car coupler having a rotary connector to which the butt end of a car coupler shank is pinned for unitary rotation. The rotary connector abuts an adjacent front follower which is held captive in the yoke. The improved rotary connector is provided with a spherical butt end, as distinguished from an open or a closed flat butt end, which is designed for seating engagement in a spherical concavity formed in the adjacent front follower.

The coaction between the spherical butt end of the rotary connector and the front follower with the concave seat, maintains the two parts in alignment and prevents movement of the front follower against the yoke to cause undue wear of both parts, especially the yoke. Moreover, the spherical butt end of the invention provides a greater thickness than a conventional flat butt end to increase the fatigue and wear characteristics of the rotary connector without adversely affecting the interchangability of the remaining parts of the draw gear arrangement.

DESCRIPTION OF THE DRAWING

The following description of the invention will be better understood by having reference to the accompanying drawing, wherein.

DETAILED DESCRIPTION OF THE DRAWING

Figure 1:
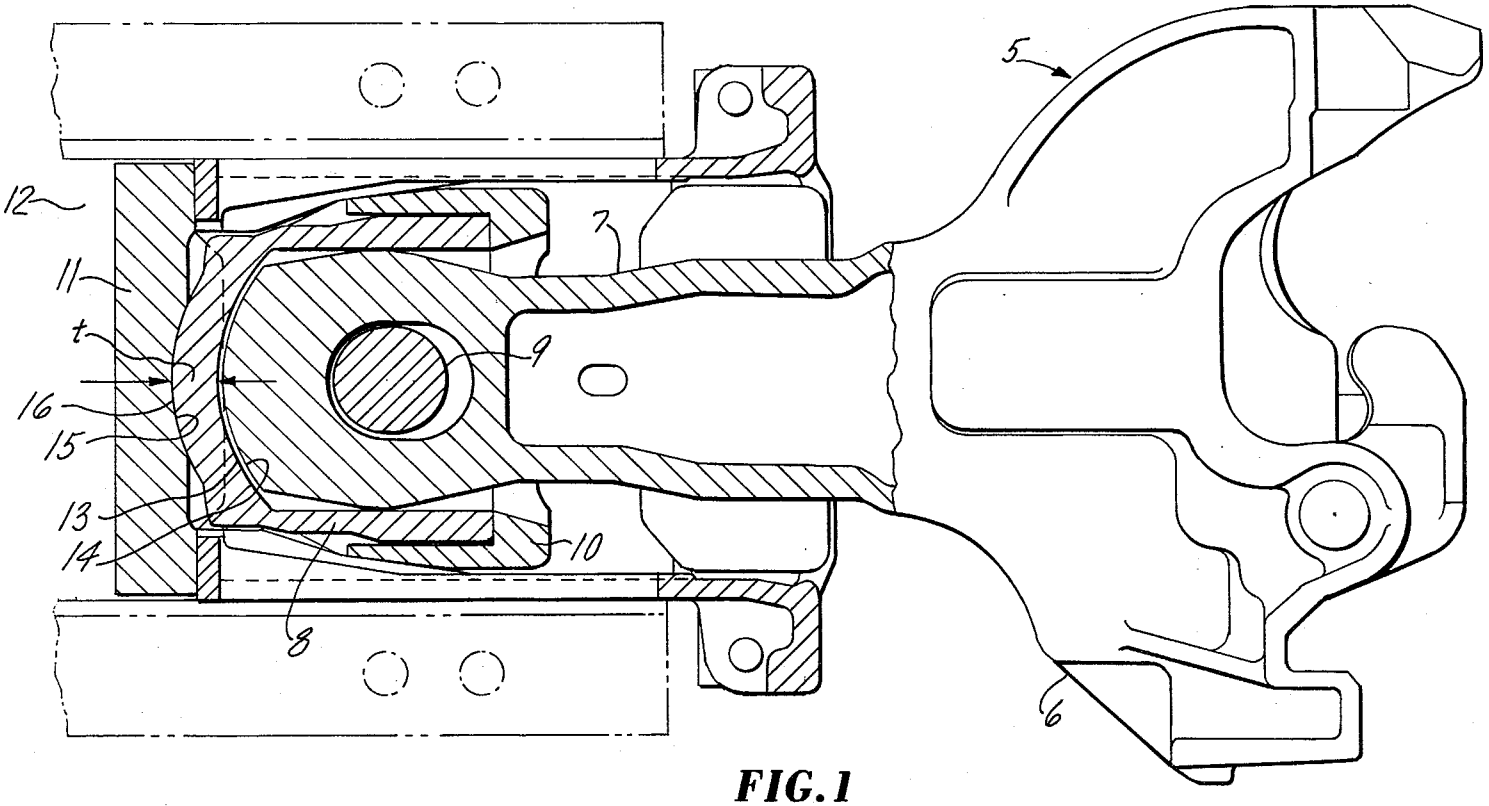
FIG. 1 is a plan view of a rotary railroad car coupler which is made in accordance with the invention, the butt end of the coupler shank and adjacent parts being shown, in section.
Figure 2:
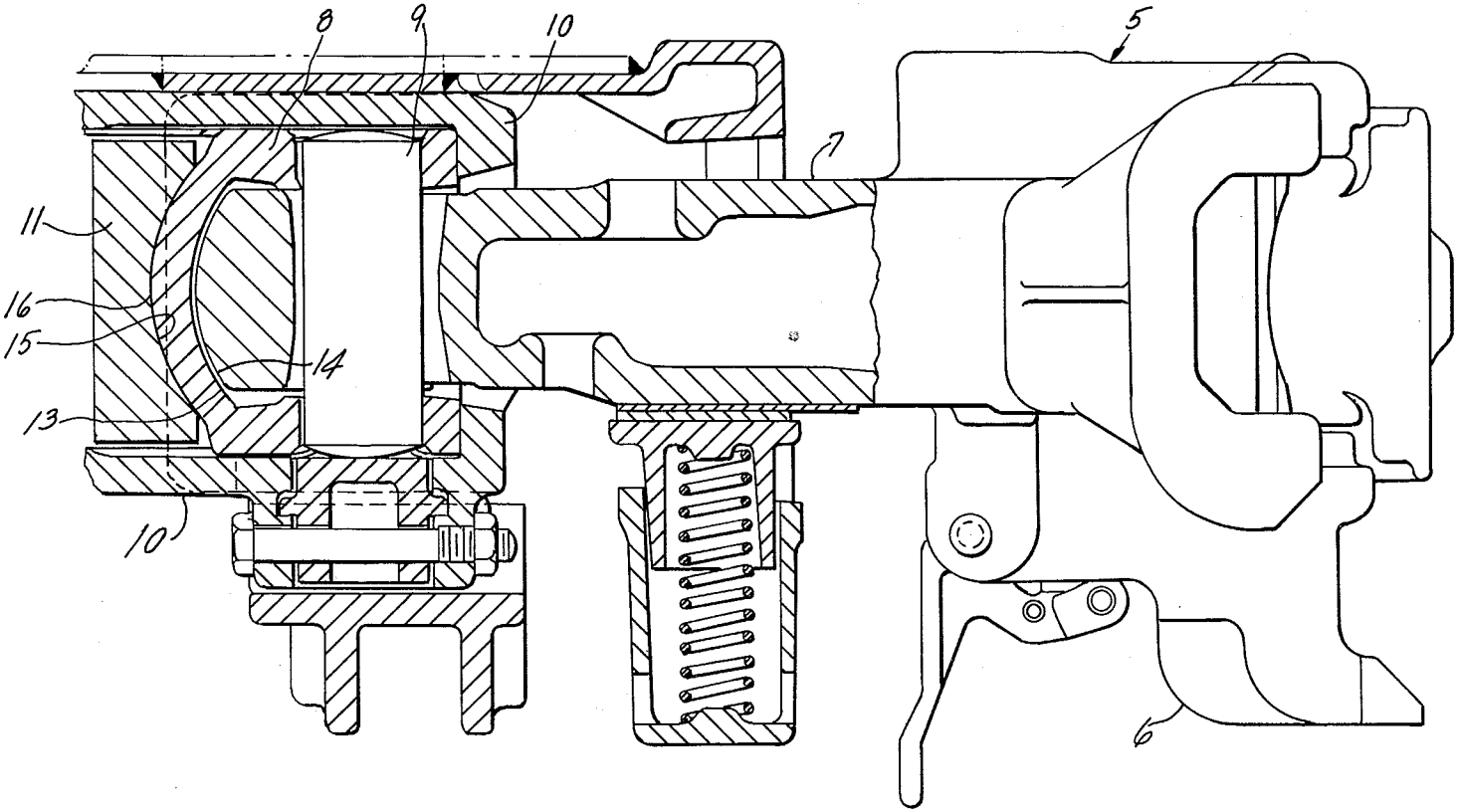
FIG. 2 is a side view of the car coupler, the butt end of the coupler shank and adjacent parts also being shown, in section.

With reference to the drawing, there is shown a rotary railroad car coupler 5 which has a coupler head 6 with an attached shank 7 that is coupled to a rotary connector 8 for unitary rotation by means of a pin 9. The rotary connector 8 is conventionally mounted within a yoke 10 for axial movement which is limited outwardly towards the coupler head 6 by the yoke 10 and inwardly away from the coupler head 6 by the front follower 11 of an adjacent draft gear 12 which is associated with the coupler 5.

The rotary connector 8 is provided with an inner, spherical seat or concavity 13 against which rests an adjacent spherical butt end 14 of the coupler shank 7. The rotary connector 8 is also provided with an outer butt end 15 which is matingly configured for seating against a concavity 16 that is formed in the adjacent front follower 11. The concavity 16 that is recessed in the front follower, for example, may be conically, frustoconically, or spherically shaped, as desired. However, some existing front followers do have spherical concavities to which a connector with a spherical butt end is readily adapted. The thickness "t" between the inner spherical seat 13 and the outer spherical butt end 15 of the rotary connector 8, measured at the longitudinal centerline of the connector, is made as large as possible while maintaining the necessary clearances between the various components, to reinforce the butt end 15 to help prevent cracking of the rotary connector 8 in this high stress area. The thickness "t" of the spherical butt end, for example, is about $1\frac{3}{8}$ inches which is about $\frac{3}{4}$ inches more than the correspondingly measured thickness of a flat butt end connector, as previously mentioned in relation to U.S. Pat. No. 2,973,105. It can be appreciated from a study of the drawing that the area of the spherical butt end 15 of the rotary connector 8 is greater than the correspondingly measured area of the spherical seat 16 of the front follower 11.

The connector 8, because of its restricted movement in radial directions relative to the longitudinal axis of the yoke, 10, will maintain the front follower 11 in coaxial alignment and prevent any vertical or lateral movement of the front follower 11, relative to the rotary connector 8, as has been experienced when the rotary connector 8 is provided with a flat butt end for engagement with an adjacent front follower that has a flat, planar surface rather than a spherical concavity. As indicated above, the thickness "t" of the spherical butt end of the rotary connector is increased from that of a flat butt end by about $\frac{3}{4}$ inches, thereby improving the fatigue and wear characteristics of a rotary connector with a spherical butt end.

Thus, there has been provided a rotary connector having improved alignment with an adjacent front follower to eliminate or substantially reduce movement of the front follower against the yoke to cause undue wear of the yoke.

What is claimed is:

1. A rotary coupler, comprising:

(a) a yoke having an opening in the front end thereof;

(b) a front follower disposed in the yoke in spaced relation from the opening in the front end and having a concavity recessed therein and facing the opening in the front end;

(c) a connector rotatably mounted in the yoke between the opening in the front end and the front follower, the connector having a butt end which is matingly configured for seating engagement in the concavity of the front follower;

(d) a coupler head having a shank extending therefrom through the opening in the front end of the yoke into the connector; and (e) means for mounting the coupler shank to the connector for unitary rotation therewith.

2. The rotary coupler of claim 1, wherein the coupler shank has a convex spherical butt end, and the connector has a matingly configured spherical concavity in spaced relation from the spherical butt end thereof for seating the spherical butt end of the coupler shank.

3. The rotary coupler of claim 2, wherein the concavity and butt end of the connector are spaced apart a thickness (t) of about $1\frac{1}{4}$ to $1\frac{3}{8}$ inches, measured at the longitudinal centerline of the connector.

4. The rotary coupler of claim 1, wherein the butt end of the connector has a greater area than the concavity of the front follower.

5. The rotary coupler of claims 1, 2, or 4, wherein the concavity of the front follower and the butt end of the connector are spherical.

6. A rotary coupler, comprising:

(a) a yoke having a longitudinal axis and an opening in the front end thereof;

(b) a front follower disposed in the yoke in spaced relation from the opening in the front end and having a spherical concavity facing the opening in the front end;

(c) a connector having a convex spherical butt end for seating in the spherical concavity of the front follower, the connector being mounted in the yoke between the opening in the front end and the front follower for rotation about its longitudinal axis which parallels the longitudinal axis of the yoke, the area of the spherical butt end of the connector being greater than the spherical concavity of the front follower, the connector being restricted for radial movement relative to the longitudinal axis of the connector and for axial movement longitudinally of the yoke and the connector having a spherical concave seat in spaced relation from the convex spherical butt end thereof;

(d) a coupler head having a shank extending therefrom through the opening in the front end of the yoke into the connector, the shank having a convex spherical butt for seating engagement in the spherical concave seat of the connector; and (e) means for mounting the coupler shank and the connector for unitary rotation.

7. The rotary coupler of claim 6, wherein the spherical butt end of the connector has a thickness (t) of $1\frac{1}{4}$ to $1\frac{3}{8}$ inches measured at the longitudinal centerline of the connector.

* * * * *